US005489232A

United States Patent [19]

Chang

[11] Patent Number: 5,489,232

[45] Date of Patent: Feb. 6, 1996

[54] MODEL MOTORCYCLE

[75] Inventor: Feng-Ju Chang, Hsin Chuang, Taiwan

[73] Assignee: Chien Ti Enterprise Co., Ltd., Taipei, Taiwan

[21] Appl. No.: 367,618

[22] Filed: Jan. 3, 1995

[51] Int. Cl.[6] ..... A63H 17/16

[52] U.S. Cl. ..... 446/440; 446/465

[58] Field of Search ..... 446/440, 465, 446/470

[56] References Cited

U.S. PATENT DOCUMENTS

| | | | |
|---|---|---|---|
| 1,708,969 | 4/1929 | Gill et al. | 446/465 |
| 2,568,374 | 9/1951 | Thomas | 446/440 |
| 2,665,521 | 1/1954 | Ford | 446/465 |
| 3,638,356 | 2/1972 | La Branche | 446/465 |
| 3,751,851 | 8/1973 | Nagai | 446/440 |
| 4,309,841 | 1/1982 | Asano | 446/440 |
| 4,342,175 | 8/1982 | Cernansky et al. | 446/440 |
| 4,463,515 | 8/1984 | Barlow et al. | 446/440 |

FOREIGN PATENT DOCUMENTS

| | | | |
|---|---|---|---|
| 1091018 | 10/1960 | Germany | 446/440 |
| 2087740 | 6/1982 | United Kingdom | 446/440 |
| 2215626 | 9/1989 | United Kingdom | 446/440 |

*Primary Examiner*—Robert A. Hafer
*Assistant Examiner*—Jeffrey D. Carlson
*Attorney, Agent, or Firm*—Lowe, Price, LeBlanc & Becker

[57] ABSTRACT

A toy vehicle including a base frame having a front end and a rear end, with a front fork unit coupled to the front end of the base frame. The front wheel mounted on the front fork is reinforced by solid spoke wheel halves coupled together and a front fender is also coupled to the front fork unit. The front fork unit includes two symmetrical sleeves on each side, one slidable within the other. The outer sleeve has a longitudinal opening and an upper stop surface. The inner sleeve has a corresponding longitudinal opening and mounts the front wheel axle at the lower end thereof. A bearing block is mounted on each side of the fender and is received through said longitudinal openings coupling the fender to the fork unit.

4 Claims, 8 Drawing Sheets

MODEL MOTORCYCLE

BACKGROUND OF THE INVENTION

The present invention relates to toy vehicles, and relates more particularly to an electric toy vehicle having a reinforced body structure.

Various toy vehicles have been disclosed, and have appeared on the market. However few toy vehicles are made corresponding to the body structure of a rear vehicle. Regular toy vehicles are commonly comprised of a solid vehicle body supported on solid wheels. These toy vehicles are not strong. More particularly, the solid wheels tend to be deformed. Because the vehicle body is made in a solid unit, the outer appearance does not cause a sense of beauty.

SUMMARY OF THE INVENTION

It is one object of the present invention to provide an electric toy vehicle which resembles the body structure of the rear vehicle. It is another object of the present invention to provide an electric toy vehicle which has a reinforced body structure. It is still another object of the present invention to provide an electric toy vehicle which is inexpensive to manufacture and easy to assemble.

According to one aspect of the present invention, the electric toy vehicle is comprised of a base frame having a front end and a rear end, a front fork unit coupled to the front end of the base frame, a rear wheel transmission unit coupled to the rear end of the base frame, a front wheel suspended from the front fork unit, a front fender coupled to the front fork unit, two symmetrical shells connected together and mounted around the base frame. According to another aspect of the present invention, the front wheel is comprised of two side-matched solid spoke wheels, and an outer tire mounted around the solid spoke wheels.

DETAILED DESCRIPTION OF THE PREFERRED EMBODIMENT

Figure 1:
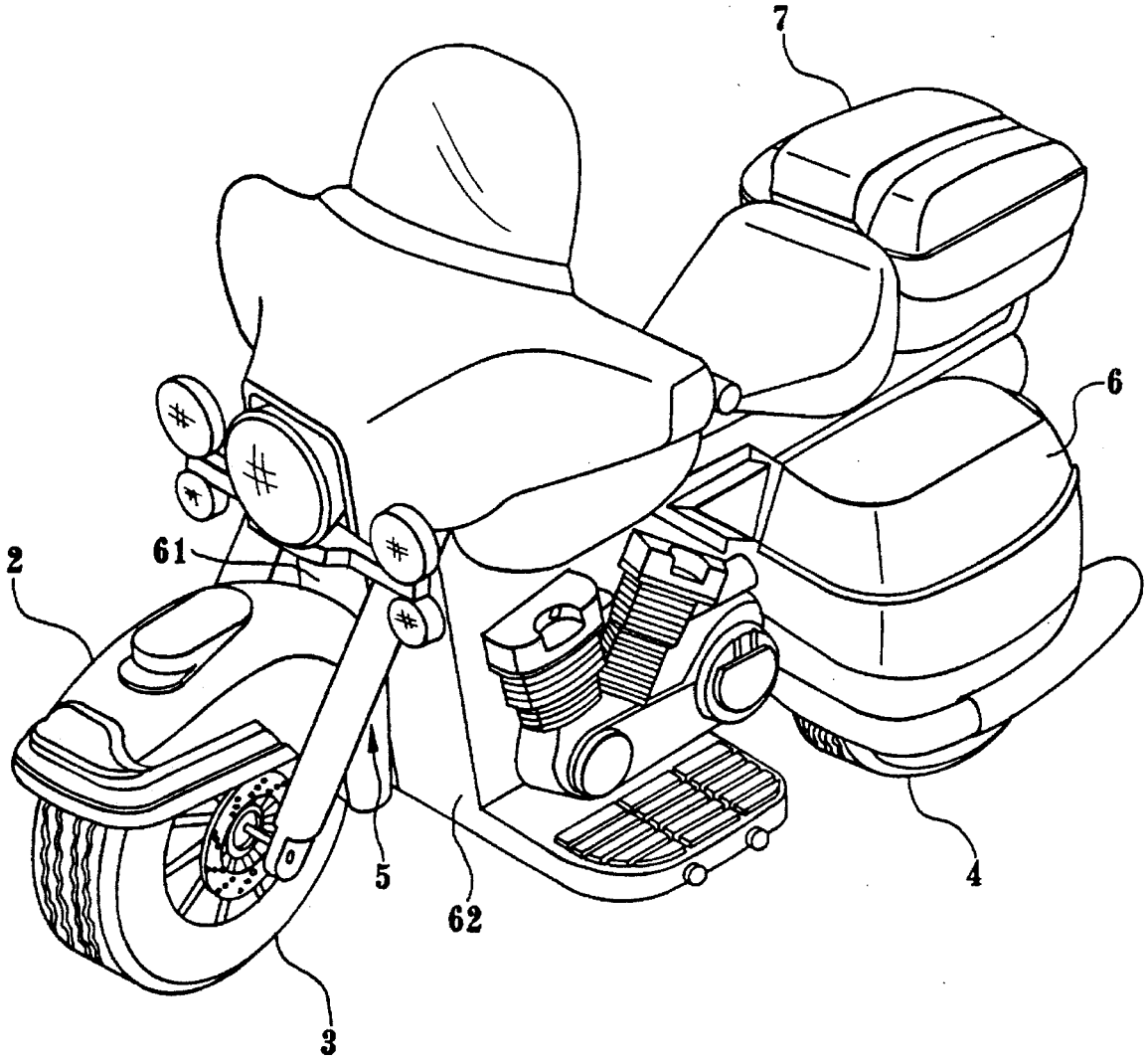
FIG. 1 is an elevational view of an electric toy vehicle according to the present invention.

Referring to FIGS. 1 through 7, an electric toy vehicle in accordance with the present invention is generally comprised of a base frame 1, a front fender 2, a front wheel 3, a rear wheel transmission unit 4, a front fork unit 5, an outer shell 6, and a rear storage box 7.

Figure 2:
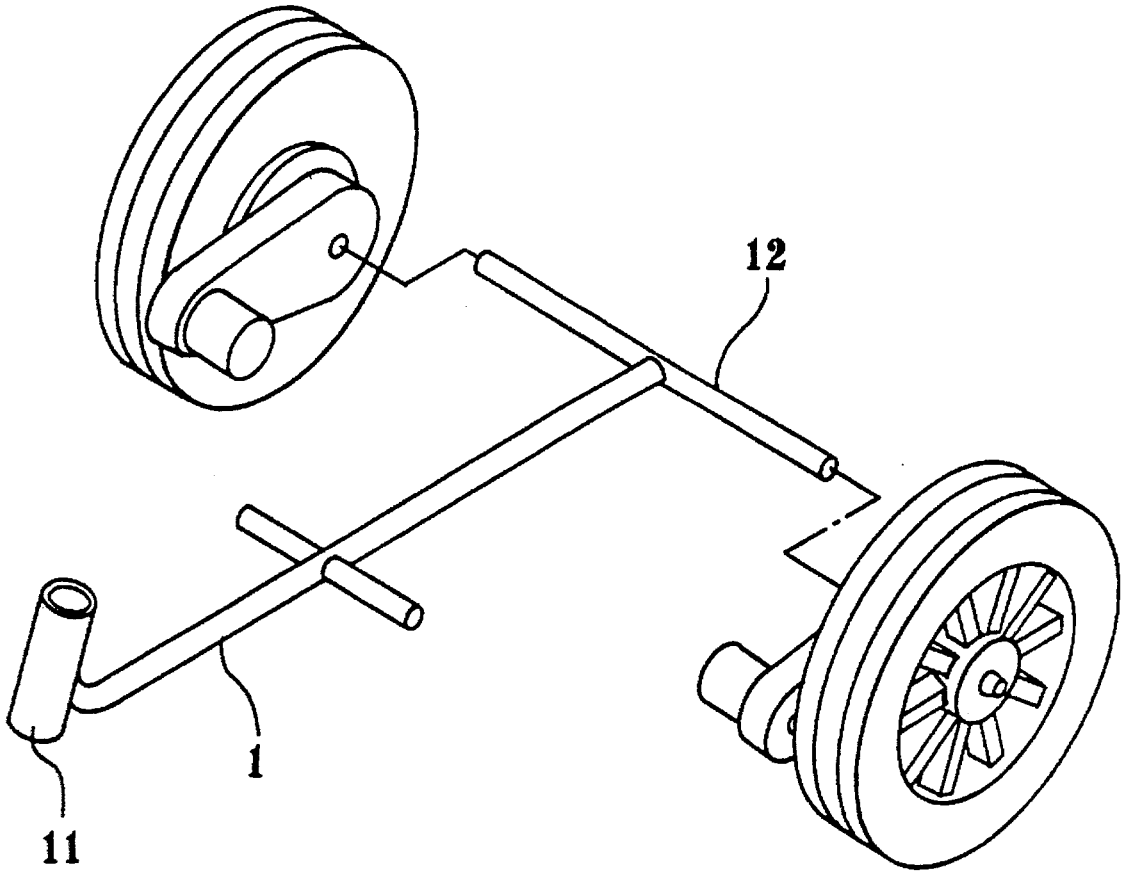
FIG. 2 is an exploded view of the base frame and rear wheel transmission unit for the electric toy vehicle shown in FIG. 1.
Figure 4:
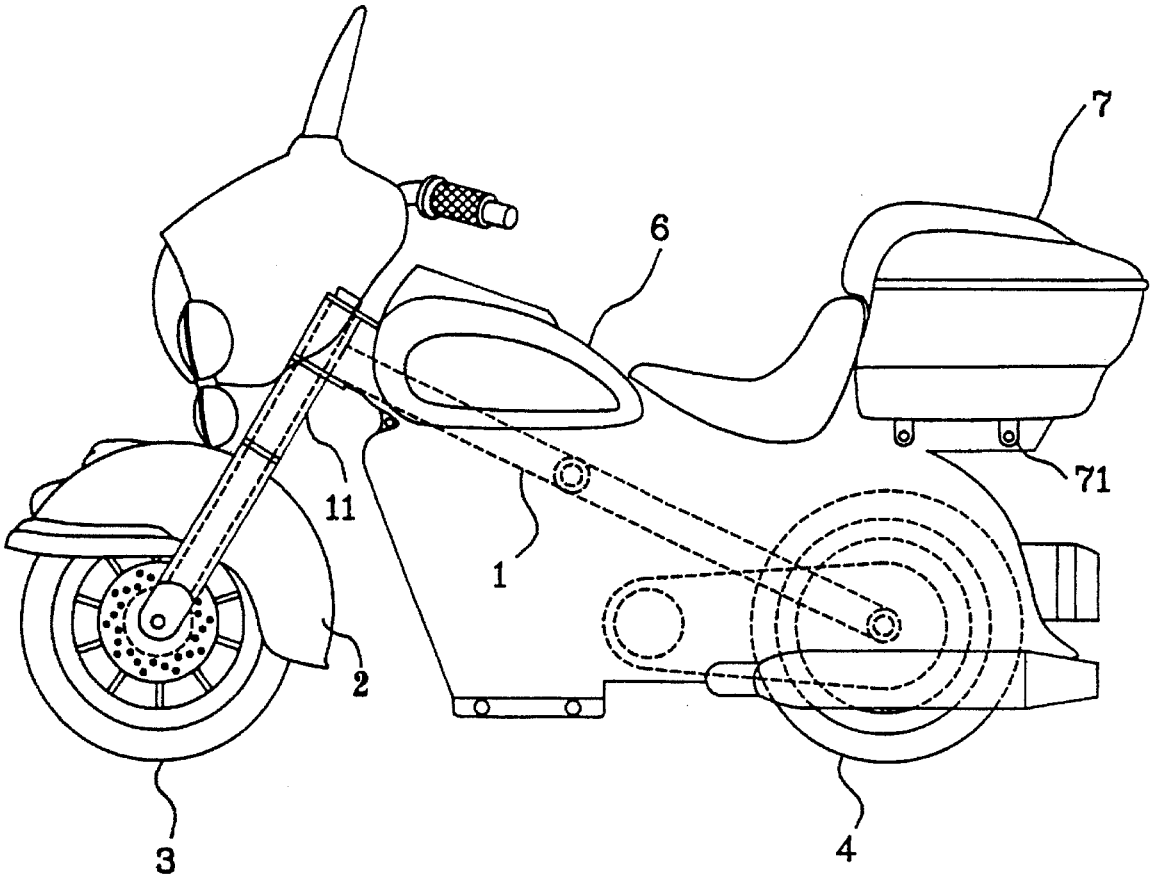
FIG. 4 is a perspective side view of the electric toy vehicle shown in FIG. 1.

The base frame 1 is shaped like the Chinese character "±", having a front end terminating in an upright connecting tube 11 and a rear end terminating in a transverse rear wheel axle 12 (see FIGS. 2 and 4).

Figure 3:
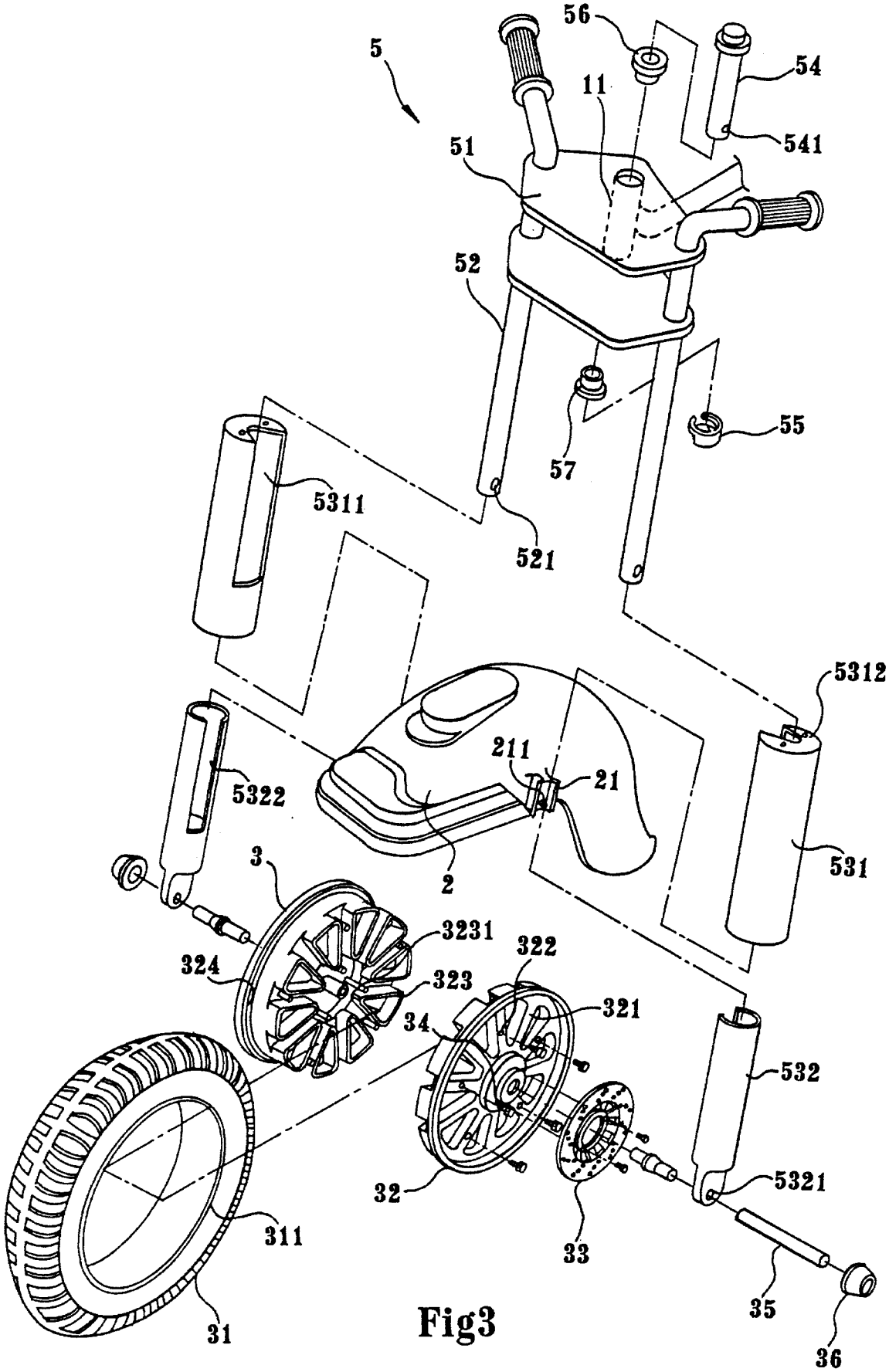
FIG. 3 is an exploded view of the front fork unit, front fender and front wheel for the electric toy vehicle shown in FIG. 1.
Figures 6, 6A:
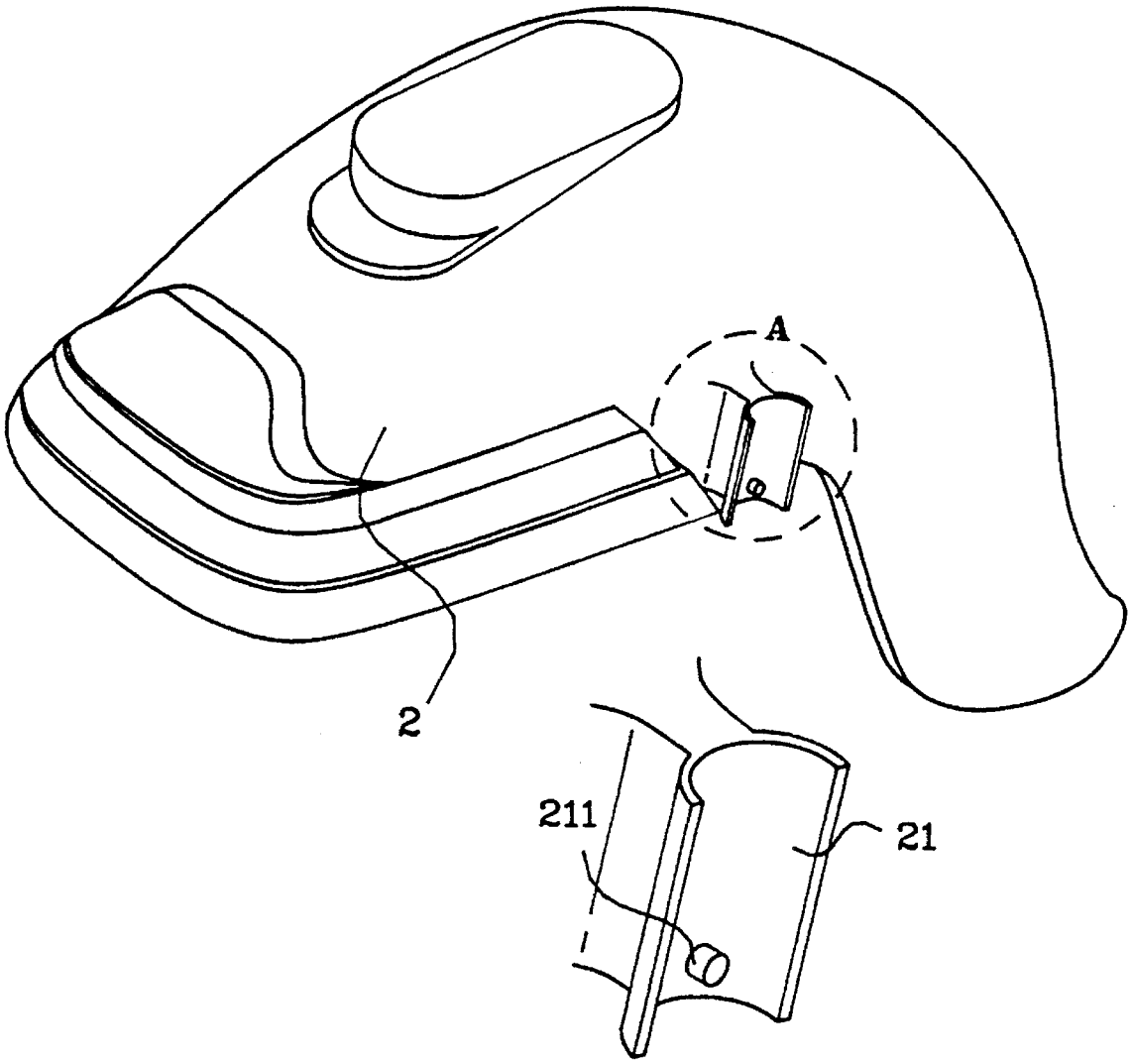
FIG. 6 is a fragmentary perspective view of the front fender of the vehicle of this invention as shown in FIG. 1.
FIG. 6A is a fragmentary detail view of detail A of FIG. 6.

The front fender 2 comprises two bearing blocks 21 respectively extended from two opposite lateral sides thereof, and two stub rods 211 respectively raised from the bearing blocks 21 (see FIGS. 3 and 6).

The front wheel 3 comprises two end-matched wheel hubs 34, two solid spoke wheels 32 connected together and securely mounted around the wheel hubs 34, an outer tire 31 mounted around the solid spoke wheels 32, a front wheel bearing axle 35 inserted through the wheel hub 34 and connected to the front fork unit 5 by end caps 36, and a front disk brake 33 fastened to one solid spoke wheel 32 by screws. Each solid spoke wheel 32 has a plurality of spokes 321, an outward flange 324 around the border fitted into a respective inside annular groove 311 on the outer tire 31. Furthermore, one solid spoke wheel 32 has a plurality of through holes 322, and the other solid spoke wheel 32 has mounting rods 323 with a respective screw hole 3231 respectively inserted into the through holes 322 and then secured in position by screws (see FIGS. 1 and 3).

The rear wheel transmission unit 4 is mounted on the transverse rear wheel axle 12 (see FIGS. 1, 2, and 4).

Figure 7:
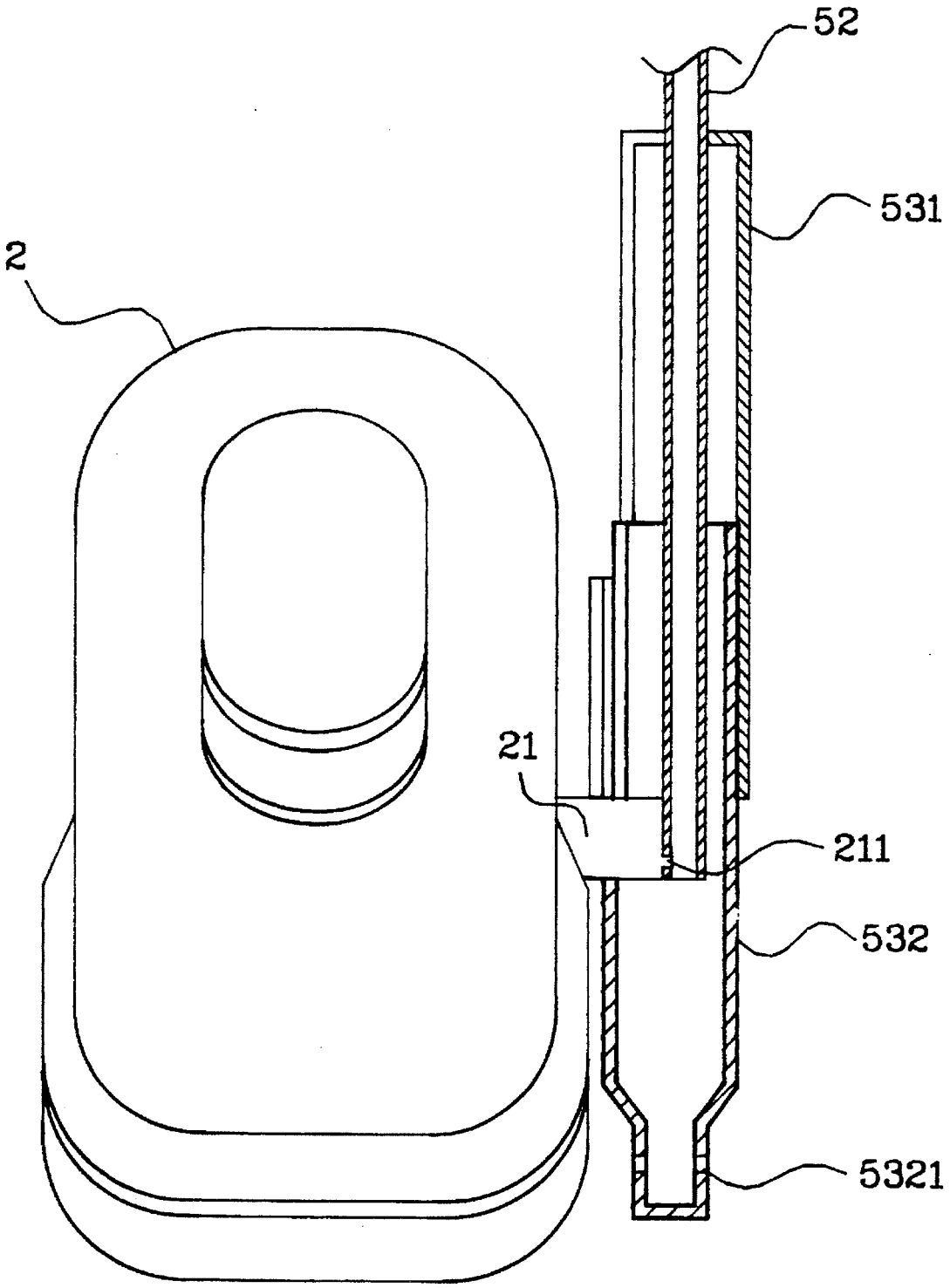
FIG. 7 is a sectional view showing the connection between the front fender and the front fork unit according to the present invention.
Figure 8:
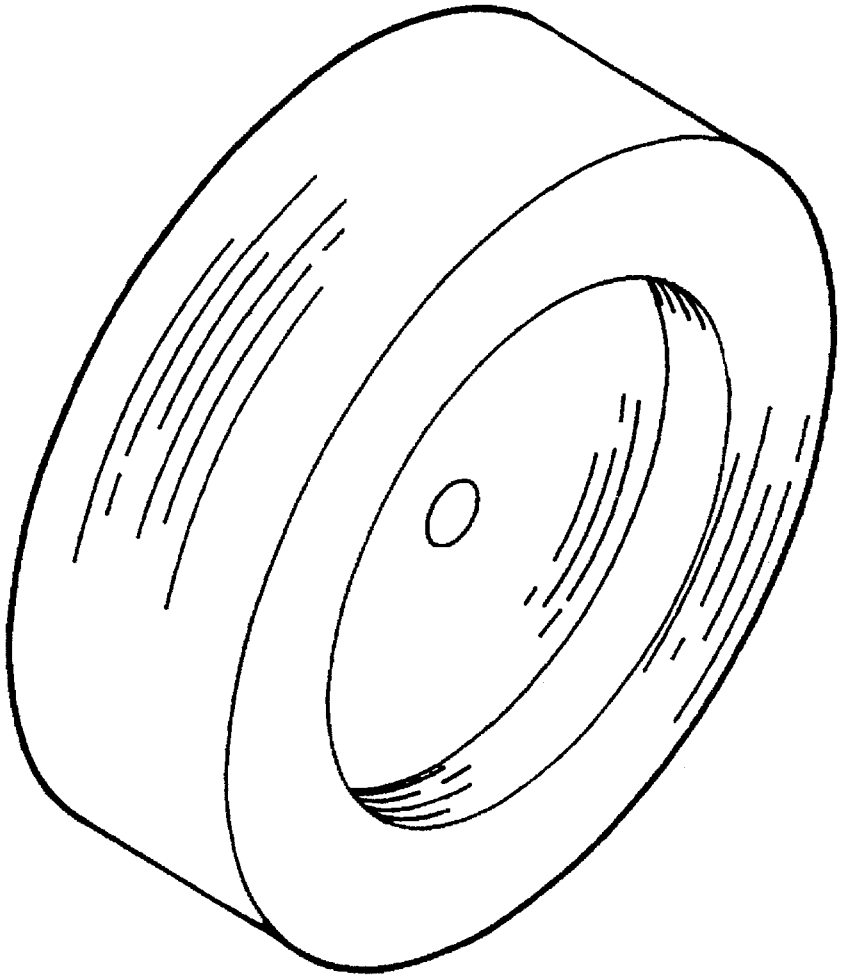
FIG. 8 shows a wheel for a toy vehicle according to the prior art.

The front fork unit 5 comprises a head block 51, two pipe sockets 56 and 57 mounted on the head block 51 at different elevations and respectively connected to two opposite ends of the upright connecting tube 11 of the base frame 1, a locating block 54 inserted through the pipe sockets 56 and 57 and the upright connecting tube 11 to hold the head block 51 and the upright connecting tube 11 together, a clamp 55 mounted around a bottom retaining groove 541 on the locating bolt 54 to hold the locating bolt 54 in place, two forks 52 respectively extended from the head block 51 and having a respective pin hole 521 near the respective bottom end respectively coupled to the stub rods 211 of the bearing blocks 21 of the front fender 2, two upper fork sleeves 531 respectively mounted around the forks 52; two lower fork sleeves 532 respectively inserted through the bearing blocks 21 and sleeved onto the forks 52 and coupled to two opposite ends of the front wheel bearing axle 35, wherein each upper fork sleeve has a longitudinal opening 5311, which receives one bearing block 21, and a top stop edge 5312, which stops above the respective bearing block 21; each lower fork sleeve 532 has a longitudinal opening 5322 at an inner side for passing the stub rods 211, and a closed bottom end terminating in a pivot hole 5321, which receives the front wheel bearing axle 35 (see FIGS. 3, 4, and 7).

Figure 5:
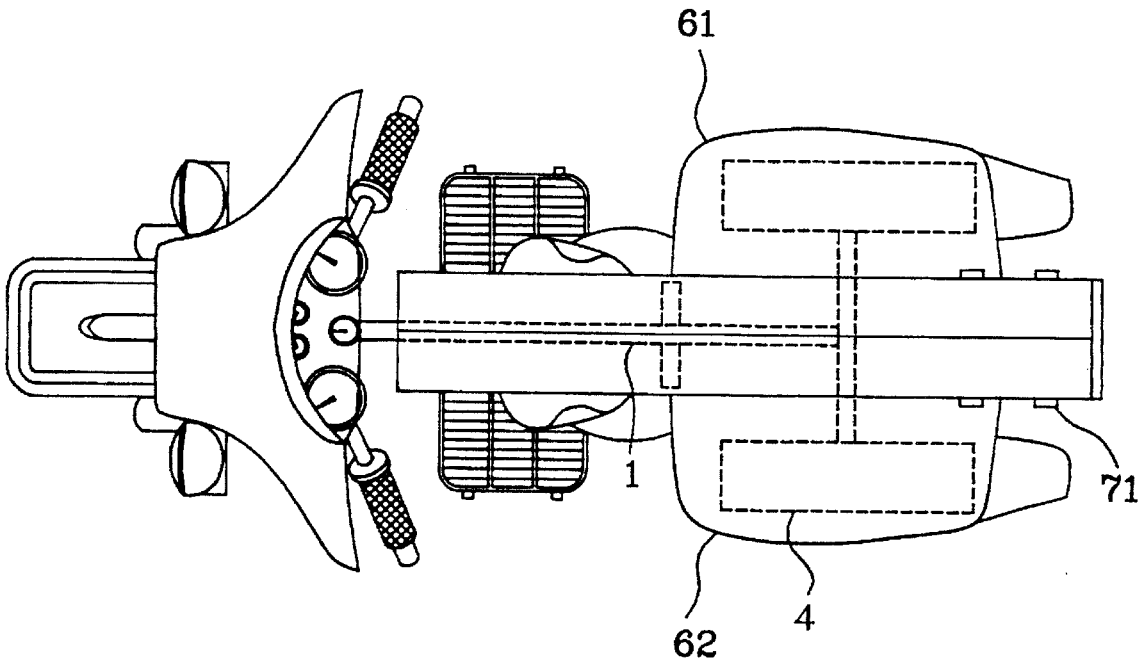
FIG. 5 is a perspective top view of the electric toy vehicle shown FIG. 1.

The outer shell 6 is comprised of two symmetrical half shells 61 and 62 connected together by screws and mounted around the base frame 1 (see FIGS. 4 and 5).

The rear storage box 7 is mounted on the rear end of the outer shell 6 at the top, having a plurality of screw holes 71 fastened to respect screw holes (not shown) on the outer shell 6 by screws (see FIGS. 1 and 5).

What is claimed is:

1. A toy vehicle comprising a base frame having a front end and a rear end, a front fork unit having opposed legs and coupled to the front end of said base frame, a rear wheel transmission unit coupled to the rear end of said base frame, a front wheel suspended from said front fork unit and reinforced by solid spoke wheels, a front fender coupled to said front fork unit, and two bearing blocks mounted respectively on either side of said front fender and extending from two opposite lateral sides thereof each having a respective stub rod connected to a leg of said front fork unit, said fork unit including two upper fork sleeves respectively mounted around opposed legs of said fork, and two lower fork sleeves, respectively, inserted into said upper fork sleeves, each pair of upper and lower sleeves surrounding a portion of a leg of said fork, each upper fork sleeve having a longitudinal opening, which receives one of said bearing blocks, and a top stop edge, disposed above the respective bearing block, each lower fork sleeve having a longitudinal opening at an inner side receiving one of said block stub rods, and a closed bottom end terminating in a pivot hole, which mounts said front wheel.

2. The toy vehicle of claim 1 wherein said base frame comprises an upright connecting tube at the front end coupled to said front fork unit, and a transverse rear wheel axle at the rear end coupled to said rear wheel transmission unit.

3. The toy vehicle of claim 2 wherein said front wheel comprises two concentrically aligned wheel hubs, two solid spoke wheel halves connected together and coupled between said wheel hubs, an outer tire mounted around said solid spoke wheels, a front wheel bearing axle inserted through said wheel hubs and coupled to said lower sleeve ends by end caps, said outer tire having two inside annular grooves, said solid spoke wheels having a respective outward flange respectively engaged into said inside annular grooves.

4. The toy vehicle of claim 3 wherein said front fork unit comprises a head block, two pipe sockets mounted on said head block at different elevations and respectively connected to two opposite ends of said upright connecting tube of said base frame, a locating bolt inserted through said pipe sockets and said upright connecting tube and secured in place by a clamp to hold said head block and said base frame together, said opposed legs extending respectively from said head block, each having a respective bottom pin hole receiving one stub rod from a respective bearing block.

* * * * *